US007980109B2

(12) United States Patent
Perret

(10) Patent No.: US 7,980,109 B2
(45) Date of Patent: Jul. 19, 2011

(54) METHOD FOR INSPECTING A STRIP IN A REVERSIBLE ROLLING MILL

(75) Inventor: Jean Perret, Montbrison (FR)

(73) Assignee: Siemens VAI Metals Technologies, Saint-Chamond (FR)

( * ) Notice: Subject to any disclaimer, the term of this patent is extended or adjusted under 35 U.S.C. 154(b) by 716 days.

(21) Appl. No.: 11/996,469

(22) PCT Filed: Jul. 21, 2006

(86) PCT No.: PCT/FR2006/001793

§ 371 (c)(1),
(2), (4) Date: Jan. 22, 2008

(87) PCT Pub. No.: WO2007/010148

PCT Pub. Date: Jan. 25, 2007

(65) Prior Publication Data

US 2008/0165351 A1 Jul. 10, 2008

(30) Foreign Application Priority Data

Jul. 22, 2005 (FR) ..... 05 52283

(51) Int. Cl.

| | |
|---|---|
| ***B21B 41/06*** | (2006.01) |
| ***B21B 1/00*** | (2006.01) |
| ***B21B 37/00*** | (2006.01) |
| ***B21B 37/72*** | (2006.01) |

(52) U.S. Cl. ..... 72/229; 72/203; 72/8.4; 72/11.5

(58) Field of Classification Search ..... 72/229, 72/203, 183, 8.3, 8.4, 11.5, 8.8, 11.1, 11.2
See application file for complete search history.

(56) References Cited

U.S. PATENT DOCUMENTS

| | | | | |
|---|---|---|---|---|
| 4,123,011 | A | 10/1978 | Kajiwara et al. | |
| 4,497,191 | A * | 2/1985 | Langer et al. | 72/229 |
| 5,660,070 | A * | 8/1997 | Muryn et al. | 72/229 |
| 6,237,205 | B1 * | 5/2001 | Yoshimura et al. | 72/229 |
| 2004/0089046 | A1 * | 5/2004 | Kramer | 72/229 |
| 2010/0064749 | A1 * | 3/2010 | Kaga et al. | 72/203 |

FOREIGN PATENT DOCUMENTS

| | | | |
|---|---|---|---|
| DE | 103 00 362 | A1 | 7/2004 |
| EP | 0 724 919 | A2 | 8/1996 |

* cited by examiner

*Primary Examiner* — Dana Ross
*Assistant Examiner* — Mohammad Yusuf
(74) *Attorney, Agent, or Firm* — Laurence A. Greenberg; Werner H. Stemer; Ralph E. Locher

(57) ABSTRACT

A method for inspecting a strip in a reversible rolling plant comprising at least one cage arranged between two winding/unwinding devices each having a mandrel. The rolling is performed in several passes until the requested thickness is obtained over the whole length of a useful part ranging between two service lengths maintained wound on each of the mandrels.

Figure 1:
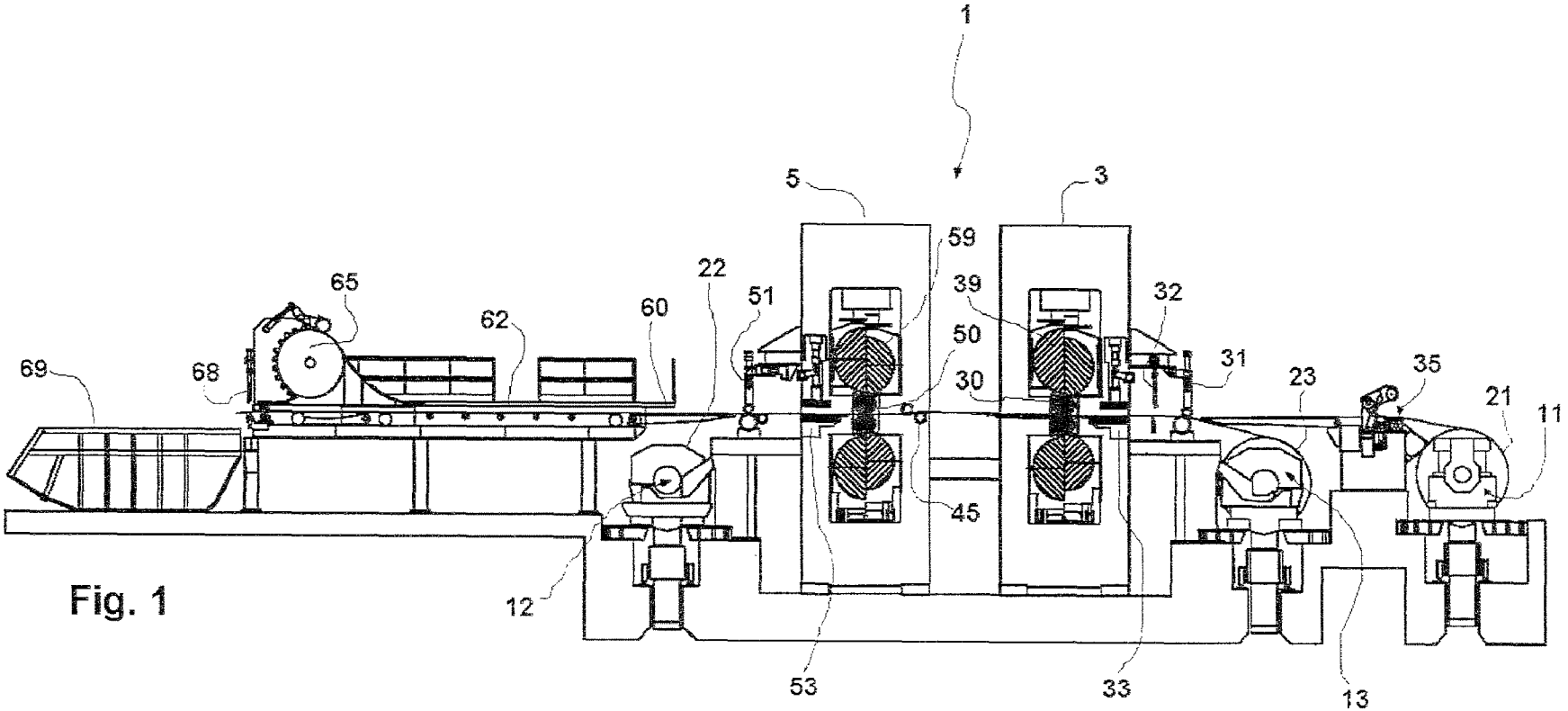

According to the invention, at the end of the last pass between a winder/unwinder placed upstream of the cage in the rolling direction and acting as an uncoiler, and a downstream winder/unwinder acting as a coiler, the upstream service length is unwound completely from the uncoiler, then subjected to a roll pass; the strip is then cut in the vicinity of the end of its useful part to release, at its rear end in the direction of the last pass, an inspection length whereof at least one part corresponds to said upstream service length rolled once.

14 Claims, 2 Drawing Sheets

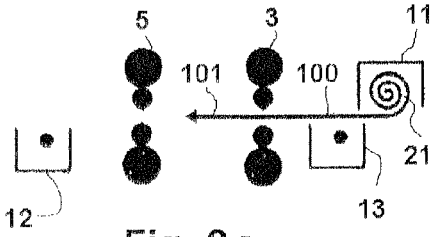
Fig. 2a
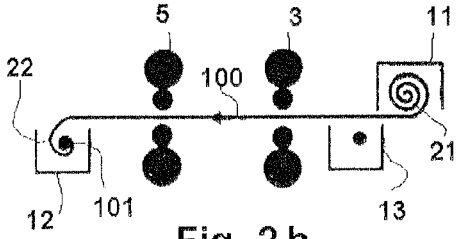
Fig. 2b
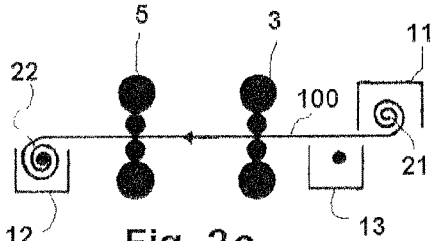
Fig. 2c
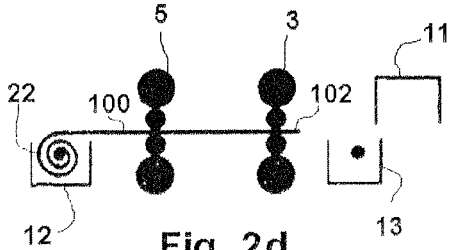
Fig. 2d
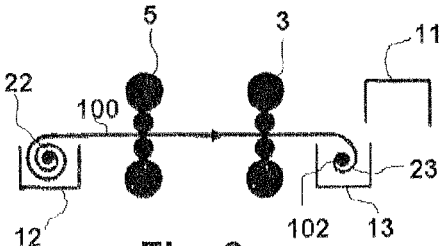
Fig. 2e
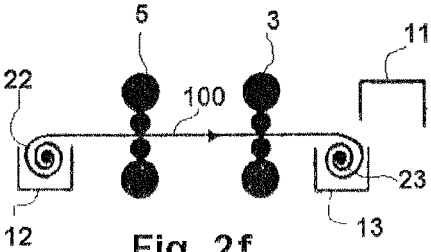
Fig. 2f
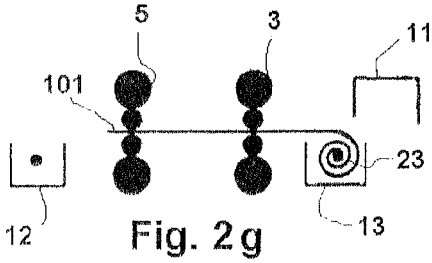
Fig. 2g
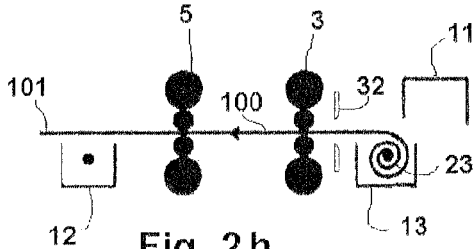
Fig. 2h
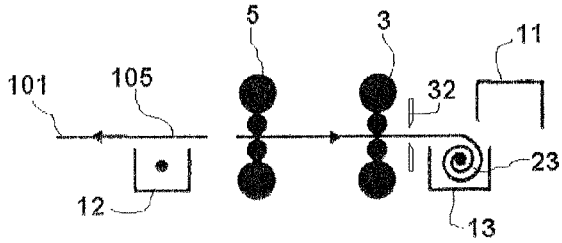
Fig. 2i
Fig. 2 j
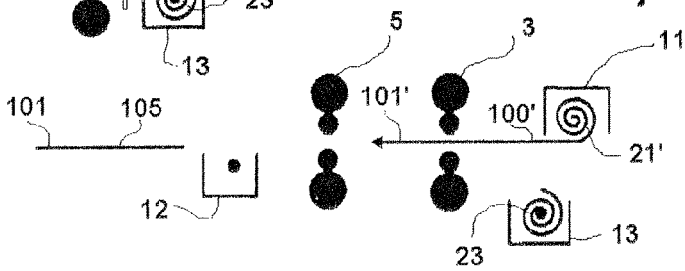

METHOD FOR INSPECTING A STRIP IN A REVERSIBLE ROLLING MILL

CROSS-REFERENCE TO RELATED APPLICATION

This application is a National Stage entry of International Application No. PCT/FR2006/001793, filed Jul. 22, 2005, the entire specification claims and drawings of which are incorporated herewith by reference.

The invention relates to rolling mills. More particularly, the invention relates to a method and an installation for inspecting the quality of a sheet metal strip after rolling.

It is known that, upon completed rolling, the rolled sheet metal strip may exhibit certain aspect defects which may be due, for instance, to a slight variation in thickness in the transversal direction, caused by the deformation and the wear of the cylinders and/or the camber of the cage, or to marks left by the working rolls, whereas certain defects may also be to back-up rolls or to the cage properly speaking.

Such aspect defects are reproduced on each face, into the longitudinal rolling direction, with a period corresponding to the development, in this direction, of the circumference of the working rolls.

Still, it is more and more necessary to deliver sheet metals with a surface quality and, generally speaking, an aspect which is as perfect as can be. To do so, the surface condition of the sheet metal strip must hence be checked at the end of the rolling, in particular, for observing the marks left periodically on the strip by the passing thereof between the working rolls.

As known, it is possible, for instance, to sample a section of the sheet metal strip exiting the rolling mill, in order to inspect both faces. The inspection is conducted on a strip length, so-called inspection length enabling to observe the marks or prints left by the cylinders of the rolling mill and the inspection length hence corresponds to the greatest period of the marks of the different cylinders. In a tandem rolling mill fitted with several cages, the inspection length corresponds to the period of the marks produced in the uppermost cage, from which the strip is subjected to the greatest elongation while passing through the following cages.

As known, the inspection may be conducted in a particular installation where certain reels are conveyed for inspection, after the production thereof by the roll plant. The inspection installation includes a so-called inspection unwinder and horizontal tables enabling to unwind a length of product corresponding to the inspection length, whereon the operator may observe, locate, draw or record in any other way the marks shown on both faces of the sample used for the inspection.

Such an inspection installation is costly to provide as well as to operate. Indeed, a reel must be removed from the produced batch, conveyed to the inspection installation, and then inspected before proceeding with the delivery thereof. However, the roll plant continues to produce during the inspection of a sample of a rolled strip, and the detection of a significant defect hence leads to rejecting then the rolled sheet metal strips produced in the meantime.

It is possible to avoid this shortcoming in continuous rolling installations including several successive cages operating in tandem, whereas the rolled strip is wound into a reel after exiting the last cage. In such a case, indeed, the winding plant includes normally at least two mandrels operating alternately, for instance on a carrousel type coiler, and the strip is cut on the fly, once completely wound on a mandrel, for further winding on another mandrel. Two successive cuts may then be performed which are spaced apart so as to sample an inspection length, the latter then being conveyed towards an inspection table thanks to switching and driving systems. This inspection length has been subjected all the rolling steps, as the remains of the strip and its surface condition is hence quite illustrative of that of the strip.

Such a method is not, however, applicable to a reversible roll plant comprising at least one rolling cage arranged between two winding/unwinding devices between which the strip circulates alternately in one direction and in the other, each winder/unwinder device acting, according to the rolling direction, as a coiler downstream of the rolling cage and as an upstream uncoiler.

Indeed, the rolling not being continuous, it is not useful to have a carrousel coiler, with on-the-fly cutting of the strip.

Moreover, according to the number of passes, the downstream coiler, at the end of the last pass, may be situated on one side or the other of the rolling mill.

In such a case, usually, the inspection length is simply sampled from the strip at the end of the last pass, on one side or the other of the rolling mill.

Obviously, this inspection length must be, then, rejected. Still, in reversible rolling, it is already necessary to reject a significant length of the strip.

Indeed, to enable tensioning of the strip, during the rolling step, in either direction, it is necessary that a certain length of strip which may be called "service length" is wound into several spires on each mandrel.

In certain cases, this service length used stretching the strip, is formed of an extension welded at each end of the strip. The latter may then be rolled conveniently over its whole length but the welding of both extensions then their retraction involves for a certain time and decreases the throughput of the installation. When the reel is of great length, it seems hence preferable to sacrifice, at each end of the strip, a service length qui is not rolled to the thickness requested and must hence be rejected.

Usually, such a reversible roll plant includes, in addition to both winding/unwinding devices, a so-called "first pass" unwinder capable of rehandling reels wound around themselves and without any traction. A reel being placed on the first pass unwinder, the product is unwound therefrom, in a first running direction, while threading its leading end through the cage for engaging it on the winder/unwinder device placed on the other side of the cage and hence acting as a coiler. The product is then wound almost completely around this coiler until its end, forming the tail of the strip, leaves the unwinder, this first pass occurring, hence, without any rolling step.

On must then reverse back for engaging the tail of the strip on the second winder/unwinder device placed on the same side as the first pass unwinder and whereon said end is fastened then wound into superimposed spires. However, the winder/unwinder placed upstream of the rolling mill, is braked so that the strip, driven by the rotation of the cylinders, is tensioned, which enables to start the rolling which is, hence, performed in the reverse direction of the first running direction during this second pass.

The running of the strip is, however stopped before the end of the unwinding operation so as to leave, on the mandrel of the uncoiler, upstream of the cage, a minimal wound length corresponding to the number of spires necessary for keeping the tension of the strip and that is called "service length".

The rolling may then be performed alternately in one direction and in the other between both winders/unwinders which act as, alternately, a coiler and an uncoiler, but, for holding at each pass the tension necessary to the rolling operation, it is necessary to keep on each mandrel a service length which is hence not rolled. At the end of the last pass, the service length situated at the tail end of the strip and not showing the required qualities must then be eliminated. Similarly, the service length situated at the leading end of the strip and wound inside the reel, should be eliminated to the end of the unwinding operation thereof.

A rolled reel is hence rolled to the requested thickness only over a central useful portion surrounded by two non rolled service lengths, which represent a loss called "scrap". As indicated above, this loss should be added usually the inspection length which is sampled from the useful portion of the strip exhibiting the required qualities. Such an inspection method hence increases the scrap.

The invention intends, in a reversible mill, to remedy this shortcomings thanks to a new process enabling on-line inspection while preserving high throughput, whereas the rejected length does not exceed both service lengths which must remain wound on each mandrel and does not exhibit hence the require thickness.

The invention also covers a rolling installation for the implementation of the method.

The invention applies hence, generally speaking, to a reversible roll plant, comprising at least one roll cage arranged between two winder/unwinder devices each having a mandrel whereon a service length of the strip is wound into several spires for tensioning the strip, the rolling being performed in several passes while maintaining the winding operation, on each mandrel, of the service length, the strip being rolled to the requested thickness over a useful part ranging between both service lengths.

According to the invention, at the end of the last rolling pass between a winder/unwinder placed upstream of the cage, in the rolling direction and acting as an uncoiler, and a downstream winder/unwinder acting as a coiler, the upstream service length is completely unwound from the upstream uncoiler and is subjected to at least one roll pass, the strip being then cut in the vicinity of the end of its useful to part, so as to release, at its rear end in the direction of the last pass, a length at least equal to a necessary inspection length, whereof at least one part corresponds to the upstream service length which has been rolled at least once and thus provides an image of the aspect failures of the useful part.

As indicated above, the reel to be rolled is often placed first of all on a simple unwinder situated on one side of the rolling mill and from which the strip is unwound to pass through the rolling mill and be attached to the winder/unwinder placed on the other side.

In case when the last reversible pass is an even pass, the strip progresses on the unwinder side. It is advantageous, at the end of the rolling of the upstream service length, that the rear end thereof is maintained clamped between the working rolls and that the rotational direction of said cylinders is then reversed so as to send backwards a sufficient length of strip to sample therein an inspection length separated from the strip after cutting said strip upstream of the cage, in the direction of the last pass, said sampled length being situated on an inspection table and the strip being returned in the direction of the last pass to wind completely on the downstream coiler.

In such a case, the inspection length is rolled twice, first of all in the direction of the last pass then in reverse direction, before being cut and sent toward the inspection table which is placed of the side opposed to the unwinder, relative to the rolling mill.

Conversely, in case when the last reversible pass is an odd pass, the downstream reel whereon the strip is wrapped, is placed on the same side of the rolling mill as the inspection table. The strip may then be cut at a distance from its rear end corresponding to the requested inspection length, this inspection length being rolled only once and sent directly toward the inspection table situated on the same side of the rolling mill.

The invention thus enables to sample from the strip an inspection length whereof at least the greatest part corresponds to one of both service lengths which remains wound on the mandrels de each of the winders/unwinders, this service length passing at least once between the cylinders of the rolling mill, which is sufficient to provide an image of possible defects generated by said cylinders over the useful length of the strip.

Thanks to the invention, the inspection length is hence not sampled from the useful portion but from the tail of the strip which, anyway should have been rejected since it had not been rolled to the requested thickness.

Generally speaking, the invention applies to any reversible mill comprising at least one cage situated between two winder/unwinder devices, but it is particularly advantageous in the case of a reversible mill provided with two rolling cages spaced apart from one another since, in such a case, the scrap is increased by the fact that the strip length included at the end of each pass, between both cages has been rolled only once into the upstream cage and therefore does not exhibit the requested thickness. The length to be rejected then includes the service length remaining wound on the mandrel to which is added the distance between both cages and the total length to be rejected is hence, normally, greater than the necessary inspection length, since the latter may, thus, be easily sampled from the tail of the strip rolled at least once during the last pass.

The invention hence enables to perform an on-line inspection without sampling any inspection length from the useful portion of the strip and, consequently to preserve high production yield.

Besides, the implementation of the method may be conducted at low cost and on existing reversible rolling installations since cutting, switching and inspection means are used which, anyway, were necessary.

The invention also covers an improved rolling mill installation for the implementation of the method according to the invention.

But other features and advantages of the invention will appear in the following description of a particular embodiment of the invention, given solely by way of illustration and without limitation thereto, with reference to the appended drawings whereon:

FIG. 1 is a diagrammatic representation of a reversible roll plant according to the invention for the implementation of the inspection method according to the invention;

FIGS. 2*a* to 2*j* are diagrammatical views of the rolling mill of FIG. 1 in different steps of the method according to the invention.

FIG. 1 represents a rolling installation provided with two reversible cages, wherein the rolling mill 1 includes two rolling cages 3 and 5 spaced apart from one another and placed between two winders/unwinders, respectively 12 and 13. The rolling mill 1 is hence a reversible mill enabling to roll a sheet metal strip in both running directions i.e. from right to left in a first running direction and from left to right in reverse direction.

In the embodiment represented on Figures, the rolling mill 1 is, moreover, associated with a first pass unwinder 11 capable of receiving a reel 21.

This reel 21 is formed of a sheet metal strip having an initial thickness which ought to be reduced by rolling to obtain a sheet metal strip having a final thickness required. The sheet metal strip is wound around itself to form the reel 21 and is first of all situated on the unwinder 11 which does not include any mandrel. Means 31 enable to grasp the leading end of the sheet metal strip and to guide it in order to pass between the cylinders of both cages 3 and 5 while unwinding to the left, the leading end of the strip being attached on the winder/unwinder 12 placed on the second side of the rolling mill 1 and which then serves as a coiler for winding the sheet metal strip. Said strip hence runs from right to left in this first running pass which takes place without any rolling until the strip is wound completely whereof the rear end, forming the tail, remains clamped between the working rolls of both cages 3 and 5, as represented schematically on FIG. 2*d*.

As usual, a second upstream winder/unwinder also called second-pass coiler 13 is arranged between the first pass unwinder 11 and the inlet to the rolling mill 1. The rotational direction of the working rolls of both cages 3 and 5 is then reversed for running the strip from left to right, in a second pass.

The right end of the strip, now the head thereof, is engaged on the mandrel of the winder/unwinder 13 which then operates as a second-pass coiler (FIG. 2*e*).

The upstream winder/unwinder 12 which operates as an uncoiler, is braked so as to tension the strip driven by the cylinders of both cages 5 and 3. The rolling may hence start at this second pass.

The rolling is then performed alternately in the first running direction from right to left, for the odd passes, and in the second direction, from left to right, for the even passes, the number of passes depending on the rolling conditions and on the final thickness required.

However, to enable the tensioning of the strip, a service length remains wound on the winder/unwinder 13 acting as an uncoiler for the odd passes as well as on the winder/unwinder 12 acting as an uncoiler for the even passes.

As known, an upstream unbending device 31 of the strip as well as upstream cutting shears 32 are situated immediately upstream of the rolling mill 1, in the first running direction.

Similarly, the upstream cage 3 includes presses 33 enabling to engage the leading end of the strip to be rolled between the trains of rolls of the upstream cage 3.

Preferably, the cages 3 and 5 are of quarto type, i.e. they include respectively two working rolls 30, 50 of smaller radius and two holding cylinders 39, 59 of greater radius.

FIG. 1 has been simplified for clarity purposes, but the rolling mill 1 also includes any means known for the rolling, as means for cooling down the cylinders, measuring the tension of the strip, cooling the strip or maintaining it, as well as deflecting rolls 45 for guiding the band.

The downstream cage 5 is identical to the upstream cage 3, except for the fact that the unbending device 51 as well as the engaging presses of the strip 53 are arranged downstream of the second cage 5, so as to enable the operation of the rolling mill in reverse direction.

A switching device 60 enables to guide the strip first of all towards an overhead conveyor, then towards an inspection conveyor forming the inspection table 62. Possibly overhead and inspection conveyors are gathered by an intermediate passage conveyor. When the sheet metal is on the inspection table 62, the inspection step properly speaking is performed by a qualified person having the necessary means.

Downstream of the inspection table 62, the roll plant includes a drum type turning-over device 65 enabling to turn over the sample to inspect it on its other face.

At the end of the inspection step, as will be described below with reference to FIG. 2, the inspected sample is rejected in a bucket 69, possibly after having been cut in pieces by means of downstream shears 68.

Besides, the reels 11, 13 and 12 are carried by jacks enabling the loading and the unloading thereof. The whole installation rests on concrete foundations. A metal stand enables to maintain and to support the different constituents of the installation.

Each of FIGS. 2*a* to 2*j* represents schematically the roll plant of FIG. 1, wherein the reference figures have been corrected to specify the same constituents. In the example represented, the upstream 3 and downstream 5 cages (in the first running direction) are of quarto type comprising two working rolls and two back-up rolls but could be of any other type. The first-pass coiler 12 and the second-pass coiler 13 are schematized with their mandrel contrary to the first pass unwinder 11 which does not comprise any. The reels 21, 22 and 23 are represented in different steps of the method according to the invention.

On FIG. 2*a*, a sheet metal reel to be rolled 21 is arranged on the first pass unwinder 11 then unwound. The leading end 101 corresponding to the front end of the sheet metal strip 100 is engaged between the working rolls of the upstream cage 3. Once the strip 100 has been engaged, the working rolls of the upstream cage 3 are used so as to apply a friction force enabling to drive the strip 100. The leading end 101 then moves in a first running direction towards the downstream cage 5 as shown by the arrow, i.e. from right to left.

On FIG. 2*b*, the leading end 101, after engagement between the cylinders of the second cage 5, has been clamped conventionally on the mandrel of the first-pass coiler 12. The working rolls of the cages 3 and 5 are clamped on the strip and driven into rotation to control the unwinding of the sheet metal strip 100 which, at the same time, is wound around the mandrel of the first-pass coiler 12 (FIG. 2*c*). During this first pass, the reel 21 is unwound while the reel 22 is wound. As the first pass unwinder 11 does not include any mandrel, it is impossible to apply a tension to the strip 100 during the first pass. Consequently, the reduction rate requested cannot be provided during this first running pass.

FIG. 2*d* represents diagrammatically the end of the last pass. The reel 21 is fully unwound and the sheet metal strip 100 is wound around the mandrel of the first-pass coiler 12 forming a reel 22. The first pass is complete when the tail end 102 of the strip 100 is close to the upstream cage 3. It is advantageous not to disengage the tail end 102 at the end of the first pass. By disengaging is meant that the tail end 102 runs past the downstream cage 5. The first pass is hence stopped at least when the tail end 102 is situated between the cages. Preferably, the first pass is stopped when the tail end 102 is still upstream of the upstream cage 3.

The operating direction of the rolling mill 1 is then reversed so as to control the running of the sheet metal strip 100 in the reverse direction indicated by the arrow represented on FIG. 2*e*. In a first step, the working rolls of the cages 3 and 5 are simply clamped for controlling the displacement of the strip 100 from left to right until its front end 102 may be fastened to the mandrel of the second-pass coiler 13.

The second pass may then start, illustrated by FIG. 2*f*, wherein the strip 100 unwinds from the reel 22 which hence operates as an uncoiler but may be braked so as to tension the strip and conduct the rolling operation between the rolls of both cages 5 and 3, the spacing between the rolls being adjusted to reach a suitable reduction rate. The strip is wound to form a reel 23 on the winder/unwinder 13 acting as a coiler. The rolling may then be conducted in successive passes between both winders, first pass 12 and second pass 13, which are equipped with the necessary means enabling to apply a torque on their respective mandrels so as to maintain the sheet metal strip 100 tensioned. Significant reduction rates may thus be obtained as of the second pass.

The number N of passes of the rolling cycle depends on the reduction rate to provide so as to obtain the final thickness requested.

However, as indicated above, solely the central useful portion of the strip is rolled to this thickness, both service lengths which must remain wound on the mandrels of both winders/unwinders 12, 13 not being rolled at each pass.

According to the invention, the inspection will be performed on a section sampled from one of both these service lengths which should, anyway, be rejected. This section should be, however, an image of the useful portion so as to exhibit the same aspect thereof and, in particular, the same marks and prints left by the rolls.

To do so, as shown schematically on FIG. 2*g*, art the end of the last pass which, in the example represented, is an even pass, the rolling is carried on between the rolls of both cages 5 and 3, until the rear end 101, in this second running direction of the strip, is released from the mandrel of the uncoiler 12 and arrives close to the cage 5.

As the strip thus remains clamped between the rolls of both cages 5 and 3, the rotational direction of said rolls is reversed so as to cause the strip to re-start in the first running direction, i.e. from right to left, on FIG. 2*h*.

The running, from right to left, is carried on until the tail end 101 of the strip, which is the front end in this first running direction, is situated at a distance from the shears 32, situated upstream of the first cage 3, at least equal to the necessary inspection length. In practice, this inspection length is, generally, slightly greater than the service length and the strip may then be cut by the shears 32, as indicated on FIG. 2*h*, along a line situated in the useful portion of the strip but close to the rear end thereof. This useful portion may hence be wound completely on the coiler 13 to form the reel 23 whereof solely the leading end forming the first spires wound on the mandrel, should be rejected since it corresponds to the non-rolled service length (FIG. 2*i*).

The remaining part 105 of the strip, which has remained clamped between the rolls of the cages 3 and 5, is driven towards the left, i.e. in the first running direction and directed by a switching device towards the inspection table 62 represented on FIG. 1.

This section 105 corresponding, at least over the greatest part thereof, to the service length, is run twice between the working rolls, respectively in the first running direction, from left to right, on FIG. 2*g* and in the second running direction, from right to left, on FIGS. 2*h*, 2*i*. Moreover, even if the rear end 101 is released from the uncoiler 12, the strip remained under tension, in both directions, between both cages 5 and 3. This part 105 is hence subjected, when passing between the rolls, to the same marks as the useful portion of the strip, since these marks are reproduced identically at each pass. The section sampled 105 hence exhibits the same aspect as the strip, which enables to check the quality thereof.

On FIG. 2*j*, the sample 105 is positioned on the inspection table where the inspection properly speaking takes place, optionally on both faces by turning the sample 105 over. Simultaneously, the reel 23 is withdrawn from the rolling installation and conveyed towards, for instance, another installation for further treatment. Similarly, during the inspection of the sample 105, a new reel 21' formed of a new sheet metal strip 100' to be rolled is loaded on the first-pass unwinder 11 and its leading end 101' is engaged in the rolling mill 1 so as to prepare the following rolling cycle.

The method of inspection according to the invention hence makes use of the fact that the non-rolled service length, which must be rejected anyway, is employed as an inspection sample since it exhibits the marks and prints left by the rolls. Indeed, although it has not been rolled to the right thickness, the non-rolled length runs between the rolls which hence leave their marks on both faces.

The inspection length must be selected so as to include at least one period of each of the marks of the trains of rolls of the cages of rolling mill. Hence the inspection length includes at least the non-rolled length, but may also be larger if the period of one of the trains of rolls requires it.

The invention hence enables to inspect on line the quality of the rolling while minimising the losses of rolled material to the thickness requested, since the inspection is realised on a part of the sheet metal which should have been rejected anyway, not being of the right thickness. Besides, the inspection operation is not time consuming. Indeed, as shown on FIG. 2*j*, when the inspection of the rolling of a first cycle takes place, the following rolling cycle may be prepared by engaging for instance the leading end 101' of the next reel 21'. The reel 23 produced is also handled synchronously with the inspection step. Moreover, the implementation of the inspection method according what has just been described does not require or hardly any modifications to the existing installations.

Other embodiment variations of the method according to the invention as well as of the roll plant are possible.

For instance, shears may be situated upstream or downstream of the rolling mill, optionally between the cages of the rolling mill. In case when shears were arranged only downstream of the rolling mill 1, once the inspection sample has been separated from the remainder of the sheet metal strip 100, the rolling mill could not be used any longer as a driving means for the sample towards the inspection table. Appropriate driving means should then be available, capable of moving the sample on the inspection table.

In such a case, however, if an odd number of passes is required, the inspection table may be situated downstream of the rolling mill 1 in the first running direction, and will enable to inspect a sample corresponding to the service length wound on the winder/unwinder 13 and, situated at the tail end in the first running direction.

In such a case, indeed, the inspection table may be placed on the same side as the coiler 12 whereon the strip is wrapped. If shears are available between the second cage 5 and the coiler 12, the latter may cut the strip at a distance from its rear end 102 at least equal to the necessary inspection length. The strip may then be wound completely on the coiler 12 and its rear part, which forms the inspection length, remains clamped between the rolls of the cages 5 and 3 which drive it towards the left, in the first running direction so as to direct it towards the inspection table. In such a case, the inspection section runs only once between the rolls of both cages 5 and 3 but this single passage is sufficient so that the rolls leave their marks and that the inspection length exhibits an aspect significant of that of the useful portion of the strip.

As indicated above, since two reversible cages spaced apart from one another are used, the inspection length remains tensioned between both cages, even after cutting the strip.

The method according to the invention is, however, applicable, to a rolling mill comprising a single reversible cage. In such a case, after being released from the uncoiler, the rear part of the strip is not tensioned any longer but the passage between the working rolls which remain clamped on the strip, enables to leave the same marks on both faces thereof, the inspection length sampled from the rear end of the strip and forming the service length, exhibiting the same aspect as the useful portion of the strip.

Although the invention has been described with reference to a particular embodiment, it is not limited to this embodiment. It covers all the technical equivalents of the means described as well as their combinations within the framework of the invention.

The invention claimed is:

1. A method for inspecting a strip in a reversible rolling plant, the method comprising the following steps:

providing two winders/unwinders each having a mandrel receiving a respective upstream or downstream strip service length wound thereon into several spires for tensioning the strip, defining a useful part of the strip between the upstream and downstream service strip lengths;

providing a rolling mill having at least one cage with cylinders between the two winders/unwinders;

rolling the strip in several roll passes, including a last roll pass, between one of the winders/unwinders placed upstream of the at least one cage in a rolling direction and acting as an uncoiler and another of the winders/unwinders placed downstream of the at least one cage and acting as a coiler until obtaining a requested strip thickness over an entire length of the useful part of the strip remaining wound on the mandrels upon each pass;

at the end of the last roll pass, completely unwinding the upstream service length from the upstream uncoiler and subjecting the upstream service length to at least one roll pass between the cylinders;

then cutting the strip in vicinity of an end of the useful part to release a length at least equal to a necessary inspection length at a rear end in direction of the last pass, defining at least one part of the strip corresponding to the upstream service length having been rolled at least once and providing an image of aspect failures generated by the cylinders over the useful part of the strip; and inspecting the aspect failures.

2. The method according to claim 1, which further comprises:

maintaining a rear end of the upstream service length clamped between working rolls of the at least one cage, at an end of the rolling of the upstream service length;

then reversing a rotational direction of the cylinders to send a sufficient length of the strip backwards to sample the inspection length therein separated from the strip by cutting it upstream of the at least one cage, in the direction of the last pass; and placing the sampled length on an inspection table and returning the strip in the direction of the last pass to be wound completely on the downstream coiler.

3. The method according to claim 1, which further comprises, at the end of the last roll pass, cutting the strip at a distance downstream of a rear end of the rolling mill corresponding to the inspection length and then completely winding on the downstream coiler while leaving an inspection length rolled once being sent towards an inspection device.

4. The method according to claim 1, which further comprises:

providing the rolling mill as a reversible mill for operation of the at least one cage for odd passes in a first rolling direction and for even passes in a reverse direction;

unwinding the strip from a reel situated on a first side of the rolling mill in a first running direction while passing through the at least one cage in an open condition;

fastening a first end at a leading end of the strip to one of the winders/unwinders placed at a second side of the rolling mill and operating as a coiler:

during the first pass, clamping the strip between two working rolls of the at least one cage being driven into rotation in the first running direction for winding the strip on the coiler at the second side of the at least one cage;

continuing the winding of the strip on the coiler until a second end at a tail end of the strip arrives close to the at least one cage;

reversing rotational direction of the cylinders to control running of the strip in the reverse direction and fastening the second end of the strip to one of the winders/unwinders situated on the first side of the rolling mill;

unwinding the strip at the one of the winders/unwinders situated at the first side of the rolling mill operating as a coiler while operating the one of the winders/unwinders at the second side as an uncoiler;

tensioning the strip to conduct a rolling of the strip during the second pass upon winding a first service length into several spires on the coiler at the first side;

stopping the running of the strip to maintain a second service length wound into several spires at the one of the winders/unwinders at the second side;

maintaining reversal of the running direction with the one of the winders/unwinders at the second side then operating as a coiler for a third pass with rolling of the strip in the first running direction;

performing the rolling in a plurality of passes, alternately odd in the first running direction and even in the reverse direction, with a service length being maintained wound, at each end of the strip, on each of the winders/unwinders;

after the end of the last roll pass between the uncoiler situated upstream of the rolling mill and the coiler situated downstream of the rolling mill, carrying on the rolling during the last pass, until releasing the upstream service length situated at the tail end of the strip, in the direction of the last pass, from the upstream uncoiler and rolling at least once;

cutting the strip at a distance from its rear end at least equal to the inspection length with at least one part corresponding to the upstream service length rolled at least once;

sending the inspection length towards an inspection device; and completely winding the strip on the downstream coiler.

5. The method according to claim 4, which further comprises, after a first rolling of the upstream service length:

stopping the rolling before a passage of the rear end of the strip and maintaining it clamped between the working rolls;

reversing the rotational direction of the cylinders for returning the strip upstream;

cutting the strip at a distance from its rear end, in the direction of the last pass, at least equal to an inspection length;

completely winding a remaining strip on the downstream coiler, in the direction of the last pass; and sending the inspection length towards the inspection device.

6. The method according to claim 1, which further comprises, after releasing one end of the strip and before unwinding an inspection length, not totally disengaging the released end from the rolling mill.

7. The method according to claim 1, which further comprises unwinding the inspection length by using the rolling mill as a driver of the sheet metal strip.

8. The method according to claim 1, which further comprises conveying the inspection length on an inspection table associated with the rolling mill.

9. The method according to claim 8, which further comprises turning over the inspection length using a drum placed at one end of the inspection table for inspecting both faces of the inspection length.

10. The method according to claim 1, which further comprises inspecting the inspection length and rejecting the inspection length in parallel with re-winding the strip on the coiler of the last pass.

11. The method according to claim 1, which further comprises positioning a reel with a band to be rolled on the first pass uncoiler, positioning a reel to be rolled and engaging the leading end of a strip for a new rolling cycle, in parallel with inspecting the inspection length and rejecting the inspection length of a preceding rolling cycle.

12. The method according to claim 1, wherein the inspection length is at a minimum equal to a length enabling observation of at least one period of marks left by trains of rolls provided on the rolling mill.

13. The method according to claim 1, which further comprises providing shears, and cutting the inspection length when a distance between the released end and the shears is equal to a necessary inspection length, during unwinding of the inspection length.

14. The method according to claim 1, wherein the rolling mill is a reversible rolling mill, the at least two cages are two rolling cages spaced apart from one another, and the cages are placed between the two winders/unwinders acting alternately as an uncoiler and as a coiler.

* * * * *